United States Patent [19]

Breneisen

[11] Patent Number: 5,060,321

[45] Date of Patent: Oct. 29, 1991

[54] POOL WINTERIZING SYSTEM

[76] Inventor: William J. Breneisen, 110 Blair Rd., Oyster Bay Cove, N.Y. 11771

[21] Appl. No.: 532,970

[22] Filed: Jun. 4, 1990

[51] Int. Cl.[5] ..... E04H 4/14

[52] U.S. Cl. ..... 4/496; 4/504

[58] Field of Search ..... 4/496, 504

[56] References Cited

U.S. PATENT DOCUMENTS

| | | | |
|---|---|---|---|
| 4,281,422 | 8/1981 | Simonelli | 4/496 |
| 4,752,979 | 6/1988 | Goacher, Sr. | 4/496 |
| 4,903,351 | 2/1990 | Dengel et al. | 4/496 |

*Primary Examiner*—Henry J. Recla
*Assistant Examiner*—Robert M. Fetsuga
*Attorney, Agent, or Firm*—Albert J. Breneisen

[57] ABSTRACT

A swimming pool winterizing system which includes a straight hollow resilient plastic member for insertion into the skimmer discharge outlet and an L-shaped hollow tubular member for insertion into the swimming pool discharge outlet. Each hollow member is of length to allow the open upper end to extend above the pool water level and allow for the blowing of forced air through the pool water lines thereby purging the water lines for the winter months without the need of lowering the swimming pool water level.

4 Claims, 1 Drawing Sheet

POOL WINTERIZING SYSTEM

BACKGROUND OF THE INVENTION

This invention relates generally to swimming pools and, in particular, to a system for winterizing a swimming pool by removing water from the various equipment and lines associated with the pool.

In many areas, it is necessary to prepare an outdoor swimming pool for winter weather by removing water from the lines connecting the pumps and filters to the swimming pool in order to preclude ice expansion and breakage of the water lines upon freezing. Thus, it is conventional to prepare the pool for cold weather by draining the plumbing lines. In the prior art, it has been typical to use a submersible pump in order to lower the water level below the skimmer and all return lines. This step allows for the water to be purged and drained from the equipment and the associated plumbing lines. After the purging and draining step, winterizing plugs are placed in the return line and sealed tightly. Thereafter, the pool is refilled to its normal level and the plugs serve to keep the water out of the plumbing.

One of the problems associated with the above described procedure is that it is expensive and wasteful to discard the water when bringing the level below the skimmer and return lines. For instance, in a 20'×40" pool, this can amount to approximately 4,500 gallons of water which must be drained and then refilled, typically with a new supply of water. Utilizing the system and method described herein avoids the need for removal of the water level and provides a simple and effective means for winterizing a swimming pool.

SUMMARY OF THE INVENTION

A swimming pool winterizing system is disclosed which is adapted to facilitate purging of the water lines without lowering the pool level. Included in the system is a substantially straight hollow tubular member which has the lower end thereof threaded to facilitate fastening to the skimmer discharge outlet. The straight tubular member is of a length sufficient to maintain the upper end above the pool water line. The system further includes an L-shaped hollow tubular member having the end of one leg thereof tapered to facilitate fastening into the water input outlet in the swimming pool. The other leg of the L-shaped hollow tubular member is of a length sufficient to maintain the upper end above the pool water line. Utilization of the system allows for winterization of a swimming pool without the prior need to remove pool water to facilitate purging and drainage.

The swimming pool winterizing system of this invention may be provided with a set of plugs adapted to close the upper open ends of the straight and L-shaped hollow tubular members. Also, the straight hollow tubular member may be made of a thin resilient plastic with an enlarged outer diameter wall suitable to absorb the forces from ice expansion in the skimmer.

Utilization of the system of this invention facilitates a method of winterizing a swimming pool by purging the water lines without lowering the pool water level. Following this method, a substantially straight hollow member is inserted into the skimmer discharge outlet with upper open end of the straight hollow member maintained above the pool water level. Also, a substantially L-shaped hollow tubular member is inserted into the swimming pool water input outlet with the upper end of the L-shaped tubular member maintained above the pool water level. With these two members in position, the filters, heaters and associated plumbing lines are purged of substantially all water therein without lowering the pool water level.

Accordingly, it is an object of this invention to provide a system for winterizing a swimming pool without the need for drainage of substantial quantities of water.

It is another object of this invention to provide a system including suitable tubing to allow the purging of the plumbing and accessory equipment associated with a swimming pool.

It is a further object of this invention to provide a system for purging the plumbing and associated equipment utilized with a swimming pool which is adaptive to resist expansion caused by freezing.

These and other objects of the invention will become more apparent from the following description of the invention, taken in conjunction with the drawings.

DESCRIPTION OF THE PREFERRED EMBODIMENT

Figure 2:
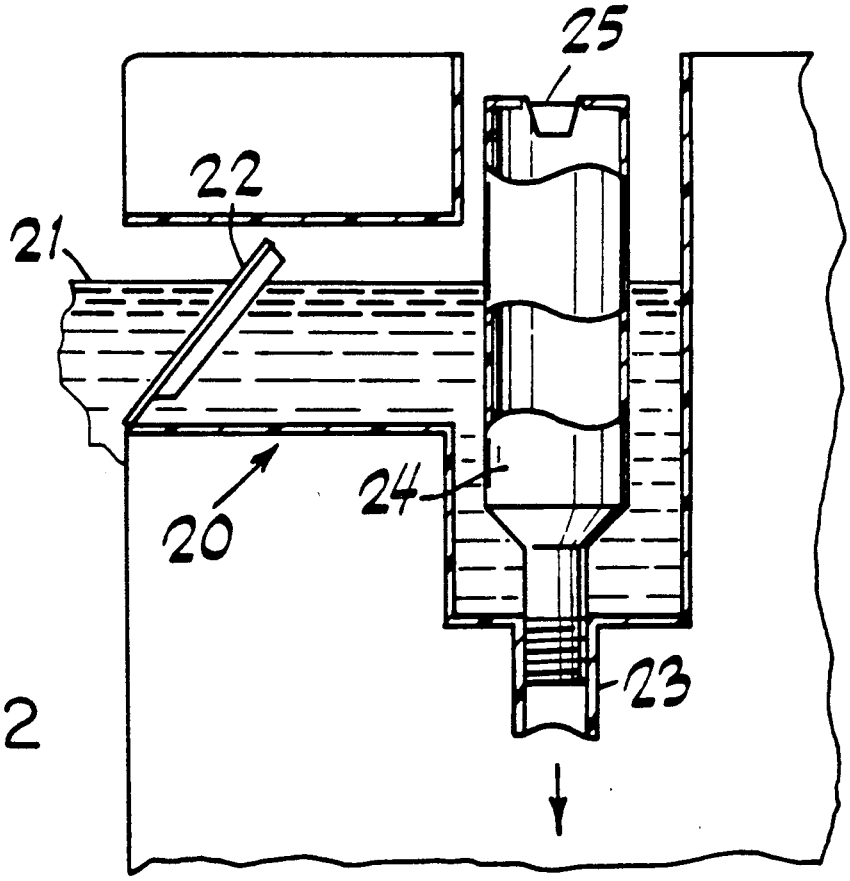
FIG. 2 is a cross-sectional elevation view of the water input line and tubular member of this invention as used in the swimming pool.

With reference to the drawings, particularly FIG. 2, a conventional pool skimmer assembly 20 is illustrated. The pool water level 21 is preferably maintained at the mid-point of the skimmer trap door 22. At the base of skimmer 20 is a discharge opening 23 which via plumbing lines typically is routed via a pump to a pool filter. After being routed through the filter, the pool water may be heated prior to return to the pool via appropriate plumbing lines.

As part of the winterizing system, a straight and hollow tubular member 24 is provided with the lower end threaded to engage with skimmer discharge opening 23. Tubular member 24 is of a length sufficient to extend above the pool water level. Tubular member 24 is provided with a thin resilient side wall and is preferably molded of plastic with an enlarged diameter to absorb expansion of any formed ice within skimmer 20. After winterization, a plug 25 is inserted to close the open end of tubular member 24.

Figure 1:
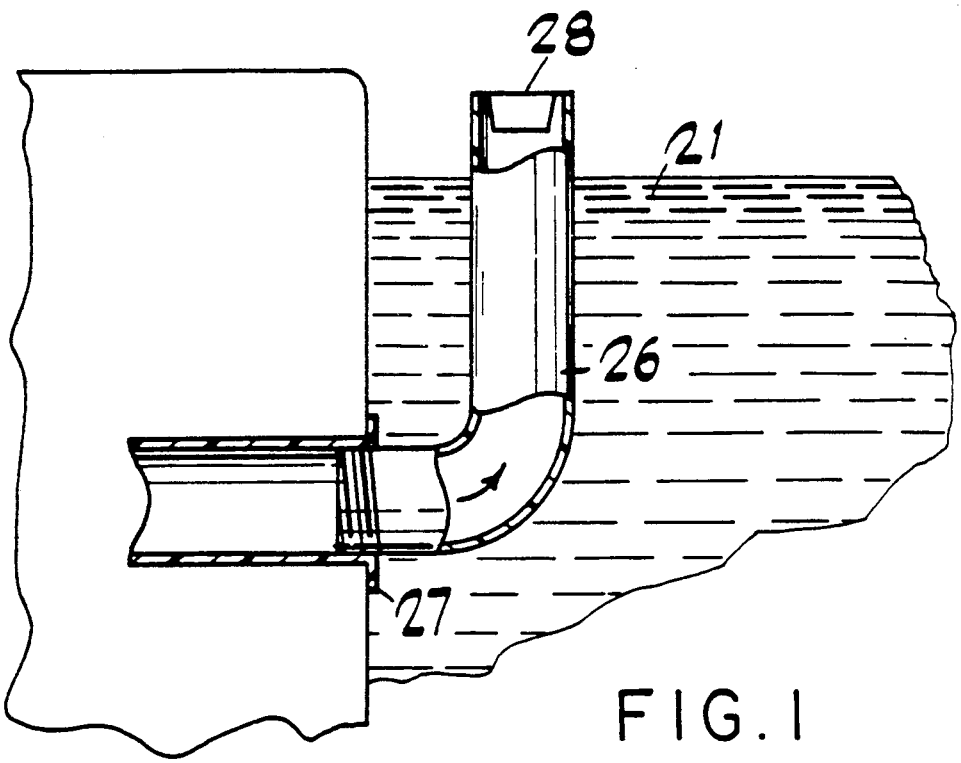
FIG. 1 is a cross-sectional elevation view of the skimmer and tubular member of this invention as used in the swimming pool.

With reference to FIG. 1, L-shaped tubular member 26 is illustrated with the end of its lower leg inserted in water input outlet 27 for the pool. Preferably, the end is tapered to allow a tight fit. L-shaped member 26 is configured with the length of the vertically extending leg sufficient to have the open end extending above the pool level 21. After winterization, a plug 28 is inserted to close the open end of tubular member 26.

In preparing a pool for winter, straight tubular member 24 and L-shaped tubular member 26 are installed in accordance with FIGS. 1 and 2, respectively. Prior to insertion of plugs 25 and 28, the pool pump is disconnected and air is forced through the return and input lines to remove any water. Anti-freeze may be intorduced into the purged lines if desired. The filter vent is thereafter opened until all water is drained from the lines. After purging and draining, plugs 25 and 28 are inserted into the purged system as shown in FIGS. 1 and 2, respectively. In this manner, a swimming pool may be winterized without the need for draining substantial amounts of water and then refilling.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. A swimming pool winterizing system adapted for use with a pool skimmer and water input system to facilitate purging of the water lines without lowering the pool water level which comprises a substantially one piece straight hollow plastic tubular member having the lower end thereof threaded to facilitate fastening to the skimmer discharge and removal therefrom, said straight tubular member being of a length sufficient to maintain the upper end above the pool water line when fastened to said skimmer discharge, said straight hollow plastic tubular member further being molded with a thin resilient plastic wall of a diameter larger than said threaded portion suitable to absorb the forces from ice expansion in said skimmer, and a one piece L-shaped hollow plastic tubular member having the end of one leg thereof adapted to be fastened into and removed from the water input outlet in the swimming pool and the other leg thereof being of a length sufficient to maintain the upper end above the pool water line when fastened to said water input outlet.

2. The swimming pool winterizing system of claim 1 which further includes a set of plugs adapted to close the upper open ends of said straight and L-shaped hollow tubular members.

3. A method of winterizing a swimming pool by using the pool skimmer and water input systems to facilitate purging the water lines without lowering the pool water level which comprises the steps of:

inserting a substantially one piece straight hollow plastic member into a vertically extending skimmer discharge outlet and maintaining the upper open end of said straight plastic hollow member above the pool water level, said straight hollow plastic tubular member further being molded with a thin resilient plastic wall of a diameter larger than said threaded portion suitable to absorb the forces from ice expansion in said skimmer;

inserting a substantially one-piece L-shaped hollow plastic tubular member into the swimming pool water inlet outlet and maintaining the upper end of said L-shaped plastic tubular member above the pool water level; and passing compressed air in the straight hollow plastic member and the L-shaped hollow tubular plastic member to purge the pool water lines of substantially all water therein without lowering the pool water level.

4. The method of winterizing a swimming pool in accordance with claim 3 which further includes the step of capping said straight and L-shaped tubular members after completion of said purging step.

* * * * *